United States Patent [19]

Bernier

[11] Patent Number: 4,896,826

[45] Date of Patent: Jan. 30, 1990

[54] TAMPER-DETERRENT FEE COLLECTING BOX FOR BUSES

[76] Inventor: Denis Bernier, 28 de l'Epée, Suite 102, Outremont, Quebec, H2V 3S9, Canada

[21] Appl. No.: 250,716

[22] Filed: Sep. 29, 1988

[51] Int. Cl.[4] ..... G07B 15/00

[52] U.S. Cl. ..... 232/7; 232/16

[58] Field of Search ..... 232/7, 9, 15, 16

[56] References Cited

U.S. PATENT DOCUMENTS

| | | | |
|---|---|---|---|
| 2,199,086 | 4/1940 | Weatherford | 232/7 |
| 3,667,485 | 6/1972 | Sesko | 232/7 X |
| 3,670,955 | 6/1972 | Dominick et al. | 232/16 X |
| 4,130,238 | 12/1978 | Williams | 232/7 |
| 4,372,478 | 2/1983 | Gomez et al. | 232/7 X |
| 4,540,117 | 9/1985 | Landry | 232/7 |
| 4,795,087 | 1/1989 | Procak | 232/16 X |

*Primary Examiner*—Robert W. Gibson, Jr.

*Attorney, Agent, or Firm*—Foley & Lardner, Schwartz, Jeffery, Schwaab, Mack, Blumenthal & Evans

[57] ABSTRACT

A tamper-deterrent box for collecting travel fees on board of a bus. It has a case at the top of which are two distinct slots for feeding paper money through one and coins to the other. Beneath each slot is a fee gathering container where the fees may be received and view for control through a window at the front of the case. The gathering containers comprise pivotable guide slides brought against the front wall of the case. A lever, operable from outside the case, may cause pivoting of the guide slides to allow the fees to fall into individual chutes and thence into one of two compartments of a fee receptacle located in a housing at the bottom part of the case. The receptacle has a door at the top connected to a first lock that allows its opening only when the receptacle is in the housing. A further lock, operable from outside the case, operates a first plate that gets inserted into the receptacle to hold it in the housing and a second plate that engages with the door to hold it open only when the receptacle is in the housing. A linkage assembly connects the lever and the second plate, the latter preventing movement of the first plate out of the receptacle unless the lever is operated which causes pivoting of the guide slides and emptying of the fee gathering containers.

18 Claims, 10 Drawing Sheets

TAMPER-DETERRENT FEE COLLECTING BOX FOR BUSES

BACKGROUND OF THE INVENTION

1. Field of the Invention

The present invention relates to a new and improved box for collecting travel fees on busses.

2. Description of the Prior Art

Present day boxes for collecting fees on busses in urbain areas where users pay their fees when boarding the bus, are of the type having a case formed at the top with a single fee-receiving trough having a slot at the bottom for receiving tickets, coins and paper money indiscriminately, which money then falls into a gathering container having a normally closed pivotable bottom which can be swung open to drain the fees into a receptacle locked in the bottom of the case. One wall of the gathering container is a window through which the bus conductor may control, approximately, whether or not the right fee has been paid. This is nowadays made more difficult by the fact that paper money is used very frequently and often prevents the conductor to assess correctly the amount that has been paid since the paper money of course tends to hide some of the coins or tickets. Also, since the coins and paper money fall pell-mell into the fee-collecting receptacle, an essential sorting becomes necessary.

Tricks have also been developed by some user to reduce the amount of the fee such as by presenting, to the trough slot, only half of a dollar bill rolled tightly so that it may not be possible for the conductor to notice this type of cheating. It has also been known that paper money has been drawn out of the gathering container by various means.

Finally, present day collecting boxes are not sufficiently sealed so that paper money can be stolen from the gathering container when the collecting receptacle is removed from the base of the case.

SUMMARY OF THE INVENTION

An object of the present invention is to lessen the above noted drawbacks by providing a fee-collecting box having two fee gathering containers, one for paper money and the other for coins and tickets. In this respect, the collecting receptacle is likewise divided into two compartments for separating the paper money from the coins and tickets.

Yet another object of the invention is to provide a collecting box having various means to prevent or deter unauthorized access to the gathering containers as well as to the collecting receptacle.

Accordingly and as broadly stated, the collecting box of the invention comprises:

a tamper-deterrent box for collecting travel fees on board of a bus, the box comprising:

a hollow case having an upper part and a lower part and including a top wall, a bottom wall, front, back and side walls; the lower part defining a housing having an opening;

a fee-collecting receptacle removably received in the housing through the opening;

means defining a first slot through the top wall for sliding paper money therethrough;

means defining a second slot through the top wall for dropping coins therethrough;

a first gathering container, beneath the first slot for receiving paper money from the first slot, the first container comprising:

a first guide slide for receiving paper money; the first slide having a free edge and being pivotally mounted for the free edge to be brought against the front wall, and a first viewing window, as part of the front wall for visioning paper money in the first container;

a second gathering container beneath the second slot for receiving coins from the second slot, the second container comprising:

a second guide slide for receiving coins; the second slide having an edge band at one end and being pivotable mounted for the edge band to face the front wall;

a second viewing window as part of the front wall;

spacer means on the edge band;

resilient means pressing the spacer means against the viewing window, constructed so that said spacer means create a space between the edge band and the second window allowing the coins to be received, in the space, only flatly and in edge-abutting relation so as to be counted through the second window, and means operable from outside the case for simultaneously pivoting the first slide away from the front wall and the second slide away from the front wall against the resilient means to free the paper money and the coins from the gathering containers to fall toward the fee-collecting receptacle.

Appropriately, the box comprises a first and a second chute members within the case for receiving the paper money and coins and for guiding same toward the fee-collecting box; the first and second guide slides being pivotally mounted on the first and second chute members, One way of avoiding tightly rolled paper money to be inserted in the first slot would be to provide means capable of adjusting the opening of the first slot to force entry of the paper money only in unfolded condition.

To render the collecting box more tamper-proof, the case upper part may comprise a head portion and a middle portion; the head portion including the case top wall and part of the front wall. The guide slides and the chute members are secured to the head portion by means rendered tamper-proof by being located inside of the head portion. And the latter is secured to the case by means that are located inside the case and accessible only through the housing opening.

Other objects and advantages of the invention will become more apparent from the description that follows of a preferred embodiment having reference to the appended drawings.

DESCRIPTION OF A PREFERRED EMBODIMENT

Figure 2:
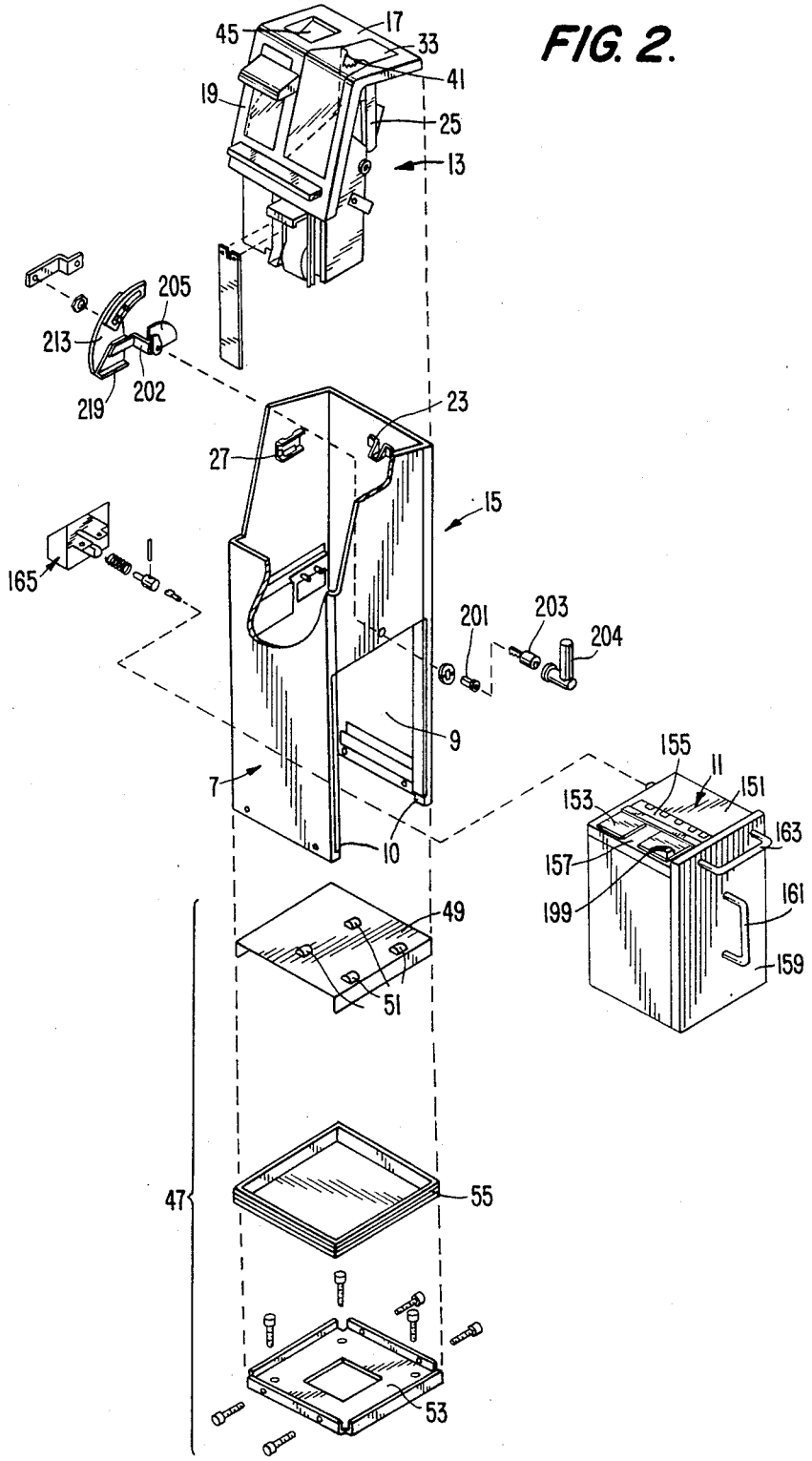
FIG. 2 is an exploded view, in perspective, of the major components of the box in FIG. 1.

The illustrated fee collecting box 1 is composed of a hollow case 3 having an upper part 5 and a lower part 7 which defines a housing 9 into which is removably received a fee-collecting receptacle 11, inserted through the housing opening 10. The upper part 5 itself, as best shown in FIG. 2, is made up of a head portion 13 and of a middle portion 15; the head portion including, in a cover member 16 (FIG. 3), the top wall 17 of the case and a part 19 of the front wall. The head portion 13 is fixed to the case 3 by a bolt 21 (FIG. 7) screwed to brackets 23, 24, inside the case and a pair of tongues 25 (only one being shown in FIG. 2) slid into two guiding brackets 27 on opposite side walls of the case middle portion 15. It will be appreciated that, in this manner, the fixing means 21, 23, 24, 25 and 27 are accessible only through the housing opening 10 and cannot therefore be tampered with for removal of the head portion 13 when the receptacle 11 is locked into the housing 9.

Figure 3:
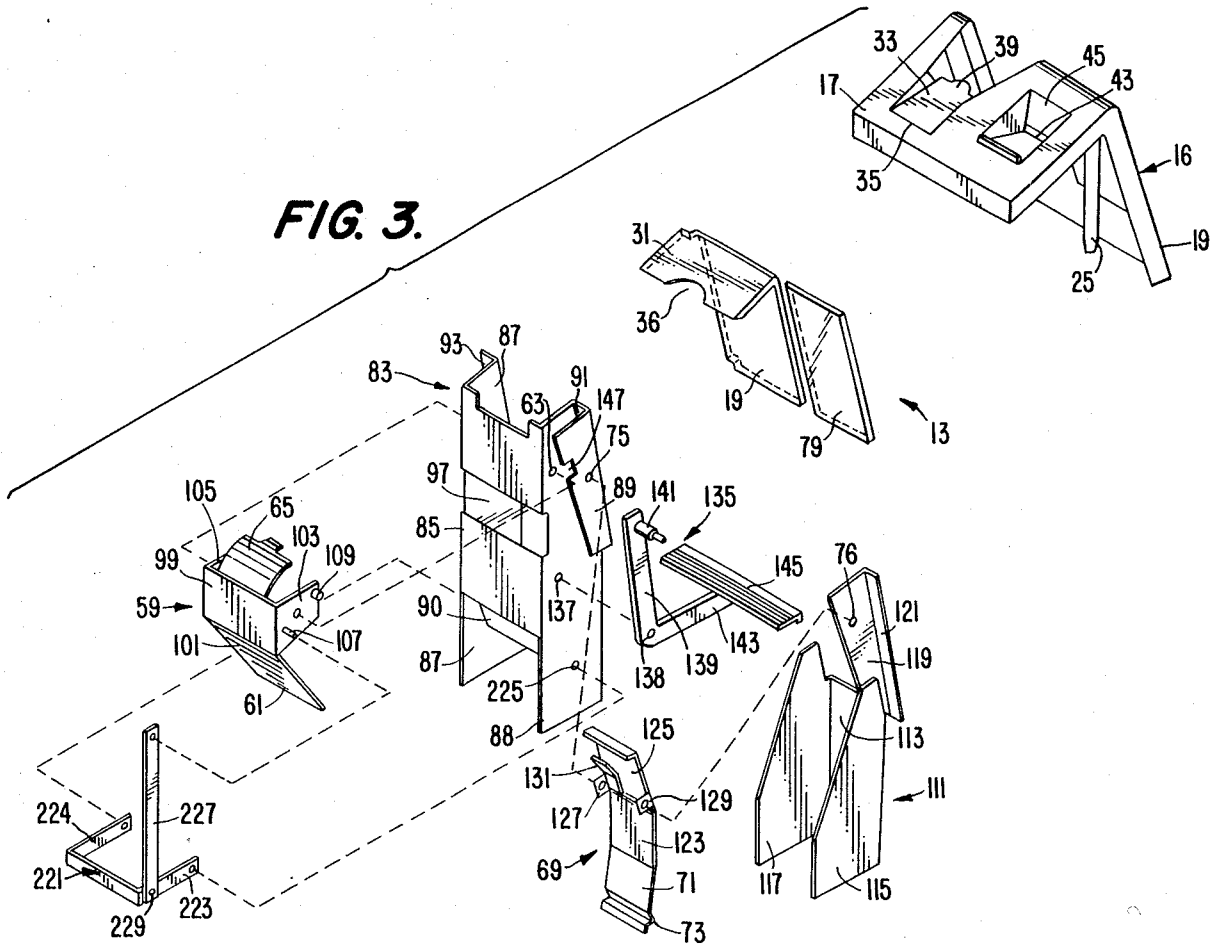
FIG. 3 is an exploded view, in perspective, of the major components of the head portion of the case.
Figure 5:
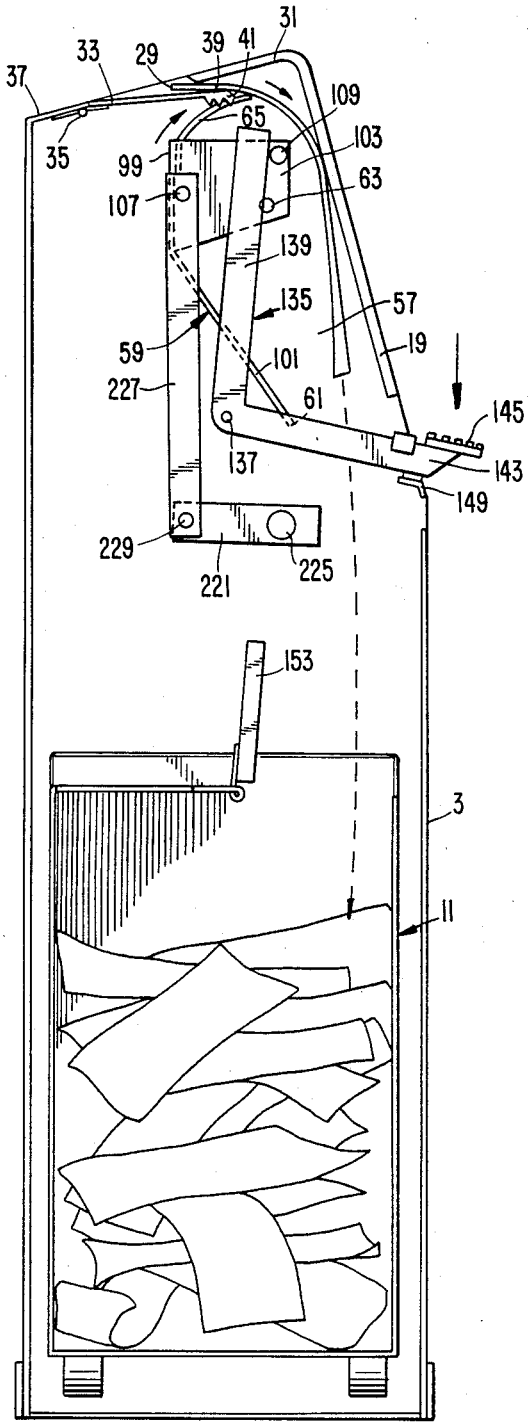
FIGS. 5 and 6 are diagrammatic side views of the box, one side wall being absent to show part only of the inner structure.
Figure 6:
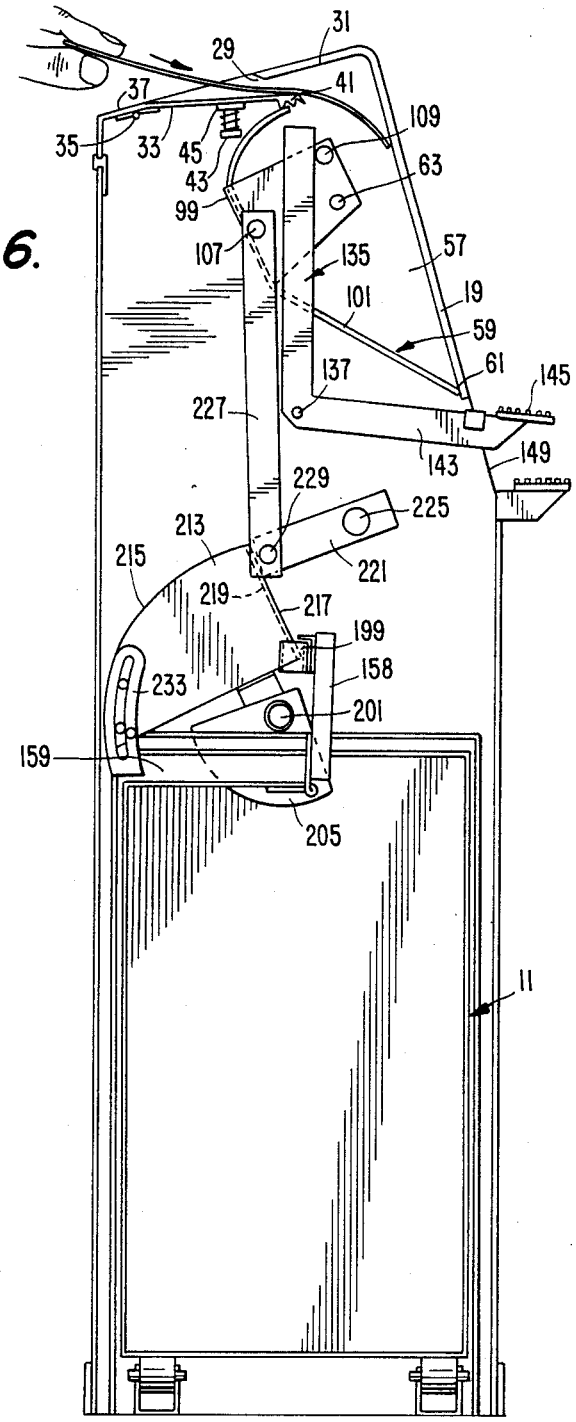

A first slot 29 (FIGS. 5 and 6) is formed through the top wall 17 for sliding paper money therethrough. As shown in FIGS. 3, 5 and 6, the slot 29 is defined by a first portion 31 of the top wall 17 and by a tongue 33 hingedly pivoted at 35 to a second portion 37 of the top wall. The free end 39 of the tongue 33 is located beneath the first portion 31, forwardly of a curved notch 36 (FIG. 3) of the portion 31. It will further be noted that this free end 39 is rounded and formed with downwardly and forwardly inclined teeth 41 to render it almost impossible to withdraw paper money through the slot 29. An adjusting screw 43 extending through a support 45 (FIG. 6) secured to and beneath the top wall portion 37 serves to move the tongue 33 with respect to the top wall portion 31 to thus vary the size of the slot 29, thereby inducing entry of paper money in flat condition.

A second slot 43 (FIGS. 3 and 7) is also formed through the top wall 17 for the insertion of coins and tickets into the case. It may be defined by a trough 45 solid with the top wall 17 and having a slotted bottom.

Figure 1:
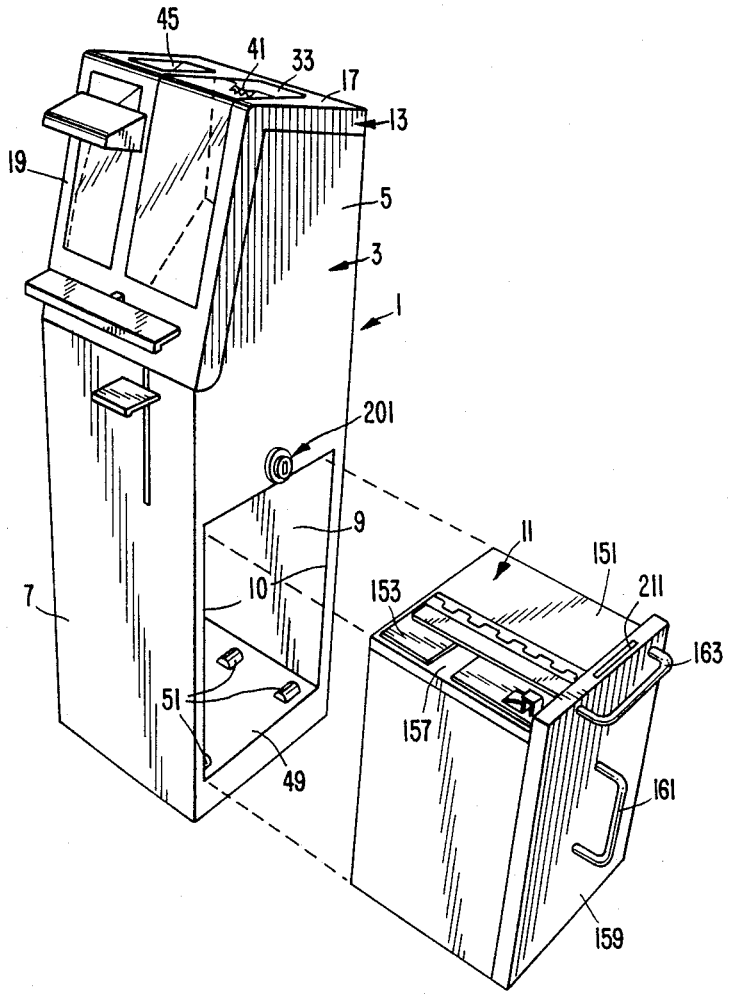
FIG. 1 is a perspective view of a fee-collecting box made according to the teaching of the invention with the collection receptacle removed.

Referring back to FIGS. 1 and 2, it is seen that the bottom wall assembly 47 of the case lower part 7 comprises a bottom wall 49 having rollers 51 to help sliding the receptacle 11 into the housing 9; bottom wall 49 being fixed to the terminal edges of the case lower part 7 and received into a base plate 53 to which it is secured. The latter is, in use, secured to the floor of a bus. A protection strip 55 of plastic material surrounds the base plate 53 and the terminal edge of the case lower part 7.

Paper money, slid through a slot 29, is received in a first gathering container 57 (FIG. 6) which comprises a first guide slide 59 having a lower free edge 61 and pivoted at 63 so that the said free edge may be brought against the front wall portion 19 by gravity, as shown or by a light spring. This first guide slide 59 can, in this manner, be moved between an open position (FIG. 5) of the first container 57, against gravity, and a closed position (FIG. 6) of container 57, by gravity, by means of an operating lever to be described later. The gathering container 57 further includes the previously mentioned part 19 of the front wall of the case upper part 6. Part 19 and part 31 of the top wall 17 are made of transparent plastic material so as to serve as a viewing window allowing the bus driver to control the amount of the paper money discharged into the container 57.

To be noted, at the upper end of the first slide 59, is a curved leg 65 immediately beneath the teeth 41 at the end of the slot tongue 33 which serves, during opening movement of the slide 59, to force the paper money into the container 57, should it be caught in the slot 29, as easily gathered from FIGS. 5 and 6.

The coins and tickets, slid through the trough 43 (FIG. 7) drop into a second gathering container 67 which comprises a second guide slide 69 formed with a transverse edge band 71 (FIG. 3) having, along its lower end, a spacer rib 73; the guide slide 69 pivots at 75, 76 and is preferably moved to closed position by a spring 77 as will be further explained hereinafter. The container 67 is closed-in, in front of the guide slide 69, by a plate 79 made of transparent plastic material and acting as a viewing window like window 19, 31 of the first container 57.

The spring 77 normally urges the guide slide 69 so that the edge band 71 is brought parallel with the viewing window 79. The height of the rib 73 is selected such that the width of the space 81 thus created is only equal to the thickness of the largest coin in circulation so that all coins are received flatly in it. Considering also the thickness of the coins in circulation, the space 81 will admit coins of varying denominations in edge abutting relation, that is, without there being any overlapping. In this manner, a conductor can easily assess if the right amount in coin money has been paid.

Referring now to FIG. 3 for more detail about the head portion 13, there is provided a first chute member 83 having generally the shape of a channel with a web 85 and a pair of lateral flanges 87, 88. A portion of the channel may however be closed by a wall (not shown) solid with the flanges 87, 88 and parallel to the web 85. The flange 88 is bent out at the top, and then backwardly over it to form a wing 89 connected to the flange 88 by a connection strip 91. The other flange 87 also forms a connection strip 93. The strips 91 and 93 serve to fix the chute member 83 on the front wall of the case and on either side of the first viewing window 19, 31 but inwardly of the case so as not to be available from the outside. When thus fixed, the top of the flanges 87, 88 act as sidewalls for the container 57. The lower portion of the chute member 83 guides the paper money into the fee receptacle 11 and may advantageously be formed with an inwardly turned downwardly inclined baffle plate 90 to facilitate the fall of the paper bills. Finally, the web 85 is broken into two portions to define an aperture 97 between them.

The first guide slide 59 is an angular member having a top plate 99 and a lower flap 101 or paper bills receiving section solid with the plate and having the free edge 61. Two flanges 103, 103 project laterally from the plate 99 and the previously mentioned curved leg 65 extends from the plate 99 also and between but upward of the flanges 103, 105. Each of the flanges 103, 105 has a pair of rollers 107, 109.

The guide slide 59 is mounted on the chute member 83 by first having its flap 101 inserted through the aperture 97 to serve as a draining bottom for the first container 57 (FIGS. 5 and 6). The two flanges 103, 105 are pivoted at 63 on the flanges 87, 88 of the first chute member 83.

The head portion 13 also includes a second chute member 111 having the general shape of a channel but reverse in orientation to that of the first chute member 83; having a web 113 and two side flanges 115, 117. Welded to the top of the flange 115 is a wing 119 having an outurned connection strip 121.

The second guide slide 69 lodges in this second chute member. It is a slightly angulated member having a lower section 123, from which angularly depends the aforesaid edge band 71, and an upper section 125 provided with a pair of lateral pivot brackets 127, 129 and with a push tab 131. Guide slide 69 is pivoted, by its brackets 127, 129, at 76 on the wing 119 of the second chute member and at 75 on the flange 88 of the first chute member 83. Its upper part 125 carries one end of the spring 77 (FIG. 7) which causes the guide slide 69 to pivot counterclockwise to press the rib 73 against the web 113, as aforesaid, to thus close the second container 67.

In assembled condition, the upper end of the flange 117 of the chute member 111 is welded to the lower end of the wing 89 of the chute member 83 to form a single piece secured to the cover member 16 by the connection strips 93, 91, 121; the connection being available solely inwardly of the case to avoid tampering.

It has been said above that means are provided that are operable from outside the case 3 for simultaneously pivoting the first guide slide 59, away from the viewing window or front wall part 19 against gravity, and pivoting the second guide slide 69 away from the viewing window 79 or, again, the front wall part 19 against the bias of the spring 77 (FIG. 7) to free the paper money and the coins and tickets and have them fall into the lower parts of the chute members 83 and 111.

These operating means comprise an L-shaped lever 135 pivoted at point 137 of the flange 88 (FIG. 3) through its apex 138. Its vertical branch 139 fits between the flange 88 of the first chute member 83 and the wing 119 of the second chute member 111. It is provided, at the upper end, with a laterally extending pressing cylinder 141 which presses on the push tab 131 of the second guide slide 69, and causes it to pivot, against the force of the spring 77, when the horizontal branch 143 is pressed down; being provided for that purpose with a transverse bar 145. At this time, the vertical branch cylinder 141 engages into a notch 147 of the wing 89. The horizontal branch 143 extends out of the case 3 through a vertical slot 149 (FIGS. 5 and 6).

At the same time, the upper end of the lever vertical branch 139 pushes on the roller 109 of the flange 103 of the first guide slide 59; the latter returning to closed position of the container 57, by gravity, upon release of the lever 135.

Referring to FIGS. 1 and 2 again, the fee-collecting receptacle 11 has completely unappertured bottom wall, front back and side walls and a partial top wall 151, all further solid with one another. A door 153, hinged at 155 to the partial top wall 151 closes the receptacle and, when locked, renders it tamper-proof. The receptacle has a transverse partition wall 157 fully across it and parallel to its front wall 159. The latter has a pair of handles 161, 163, for removing and replacing the receptacle. The partition wall 157 divides the receptacle into a paper-money collection compartment and a coins and tickets collecting compartment respectively in alignment with the chute member 83 and with the chute member 111, when the receptacle 11 is in the housing 9.

Referring to FIGS. 4, 8, 9 and 10, there is illustrated a tamper-proof locking system 165 which allows opening of the door 155 of the receptacle 11 only when the latter is fully inserted in the case housing 9. Opening of the door can at the moment be achieved by another locking system or rotary mechanism 67 which, at the same time, locks the receptacle 11 in the housing. In order to remove the receptacle, it is therefore necessary to close the door. Once the door is closed, the receptacle can be removed from the housing but as soon as it starts to move out, the door lock system 165 completely blocks the door so that no access to the money in the receptacle can be had except with a key which is in the possession of an authorized attendant.

The lock system 165 comprises a conventional barrel lock including a barrel part 169 and a key part 171. The former is mounted on the rear wall of the receptacle 11. It is supported by a bracket 173, inside the receptacle, and extends out of it. In known manner, the barrel part 169 has a central inner barrel (not shown) and an outer sleeve over the central barrel which is released and becomes rotary only when the key 175 of the key part 171 is introduced into the key slot of the central barrel but which becomes non-rotatable when the key is removed. The key 175 is axially fixed at the front end of a cylindrical hub 177 slidably but non-rotatably mounted in a hollow cylinder 179 secured to the case 3 through an enclosing cap 181 welded to the case 3. An adjustment arm 183 extends coaxially away from the hub 177 and projects slightly out of the cap 181. It is provided with a small tip 185 suitable for adjusting the position of the key 175. Indeed, while the latter is essentially non-rotatable, it is still possible to give a slight angular shift to ensure proper alignment with the key slot of central barrel. Otherwise, however, the key 175 and the hub 177 are sealed within the cap 181. A spring 187 surrounds the arm 183 between the hub 177 and the nearby wall of the cap 181 and serves to absorb shocks to which the key 175 may be subjected in use. The barrel part 169 should be tapered at the front to facilitate its insertion into the hollow cylinder 179.

Figure 9:
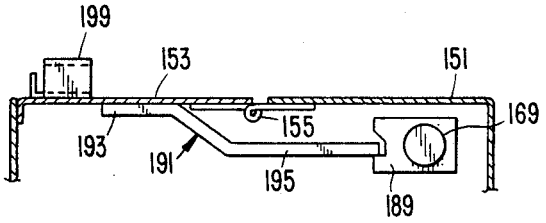
FIGS. 9 and 10 are cross section along lines IX—IX of FIG. 8, showing the receptacle door locking mechanism in FIG. 11 is a front view of the mechanism for moving paper money in the corresponding chute, and packing it in the fee-collecting receptacle.
Figure 10:
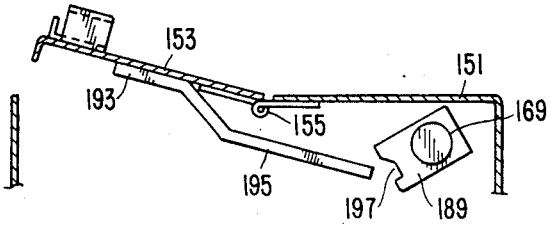

FIGS. 9 and 10 show cooperating means on the door 153 and on the rotary sleeve of the barrel part 169 to allow pivoted opening of the door upon full insertion of the key 175 into the central barrel of the barrel part 169 and its locking in closed position when the key 175 is removed as when the receptable 11 is moved out of the housing 9. The cooperating means are in the form of a radial plate 189 secured to the outer sleeve of the barrel part 169 and of a Z-shaped actuating lever 191 of which one arm 193 is welded to and beneath the door 153 and the other arm 195 has a free end engageable into a slot 197 having a straight radial face and an inclined face. In both FIGS. 9 and 10, it is assumed that the key 175 is fully entered into the key slot of the central barrel of the barrel part 169 so that the outer sleeve is free to rotate which may be obtained by the above-mentioned rotary mechanism 167 coacting with a bracket 199 solid with and projecting up from the door 153, in a manner described below.

Figure 7:
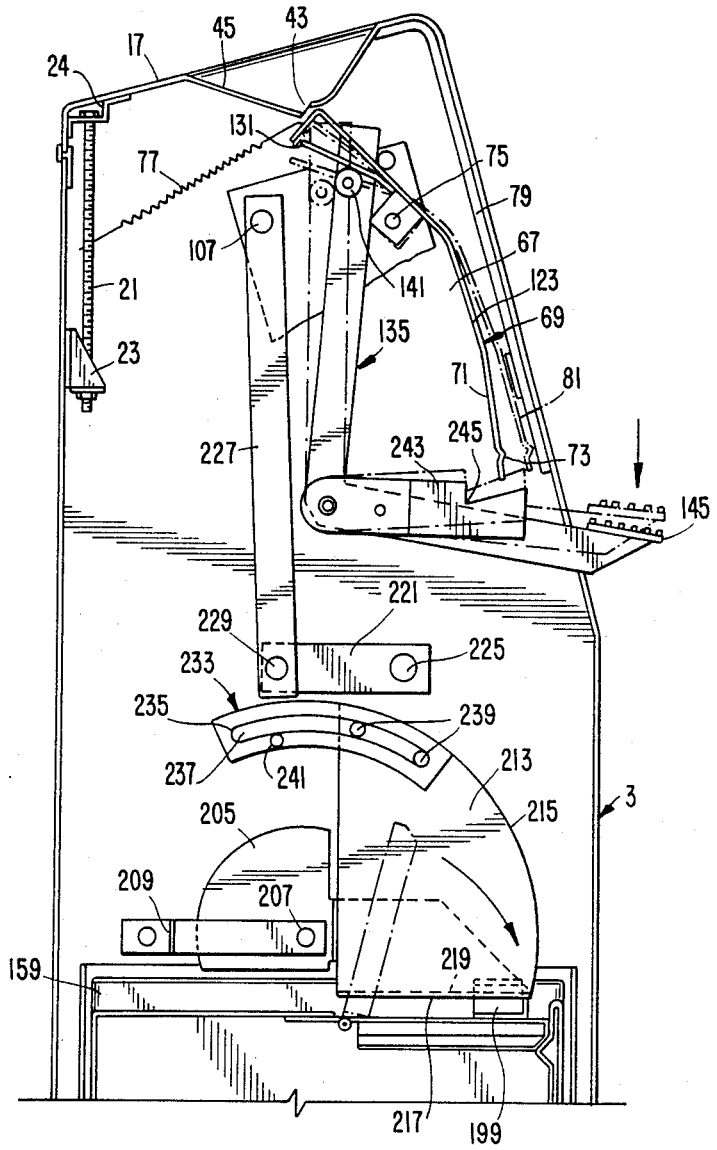
FIG. 7 is a view similar to those of FIGS. 5 and 6 but of the upper part only of the box.
Figure 8:
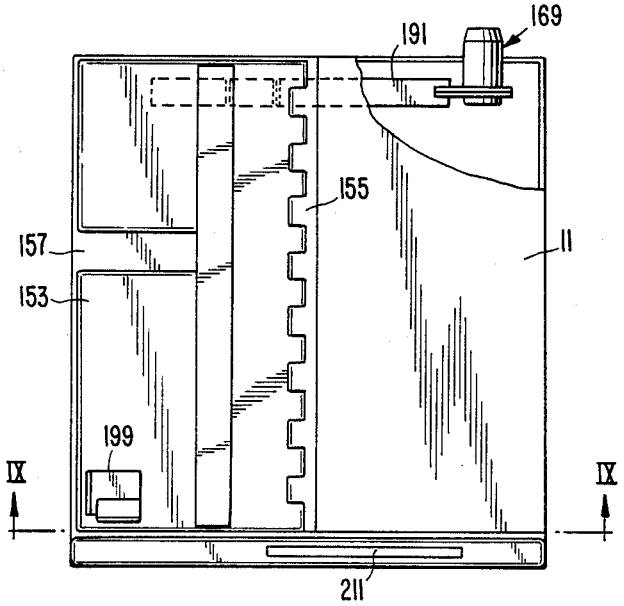
FIG. 8 is a top plan view of the fee-collecting receptacle.

The rotary mechanism 167 comprises a lock 201 operable by a key 203 with the preferably assistance of a lever 204 (FIG. 2) from the outside of the case 3 and of the same general barrel type as the barrel lock 169, 175 described above. In this case, however, the key 203 and the central barrel (not shown) of the lock 201 rotate together and drive the outer sleeve 207 in rotation which the key 203 is rotated by the user. The rotation is between a locking position (FIG. 6) of the receptacle within the housing and a freeing position allowing its removal (FIG. 7). Upon rotation to locking position, the door 153 is opened by the mechanism which closes it during reverse rotation.

Figure 4:
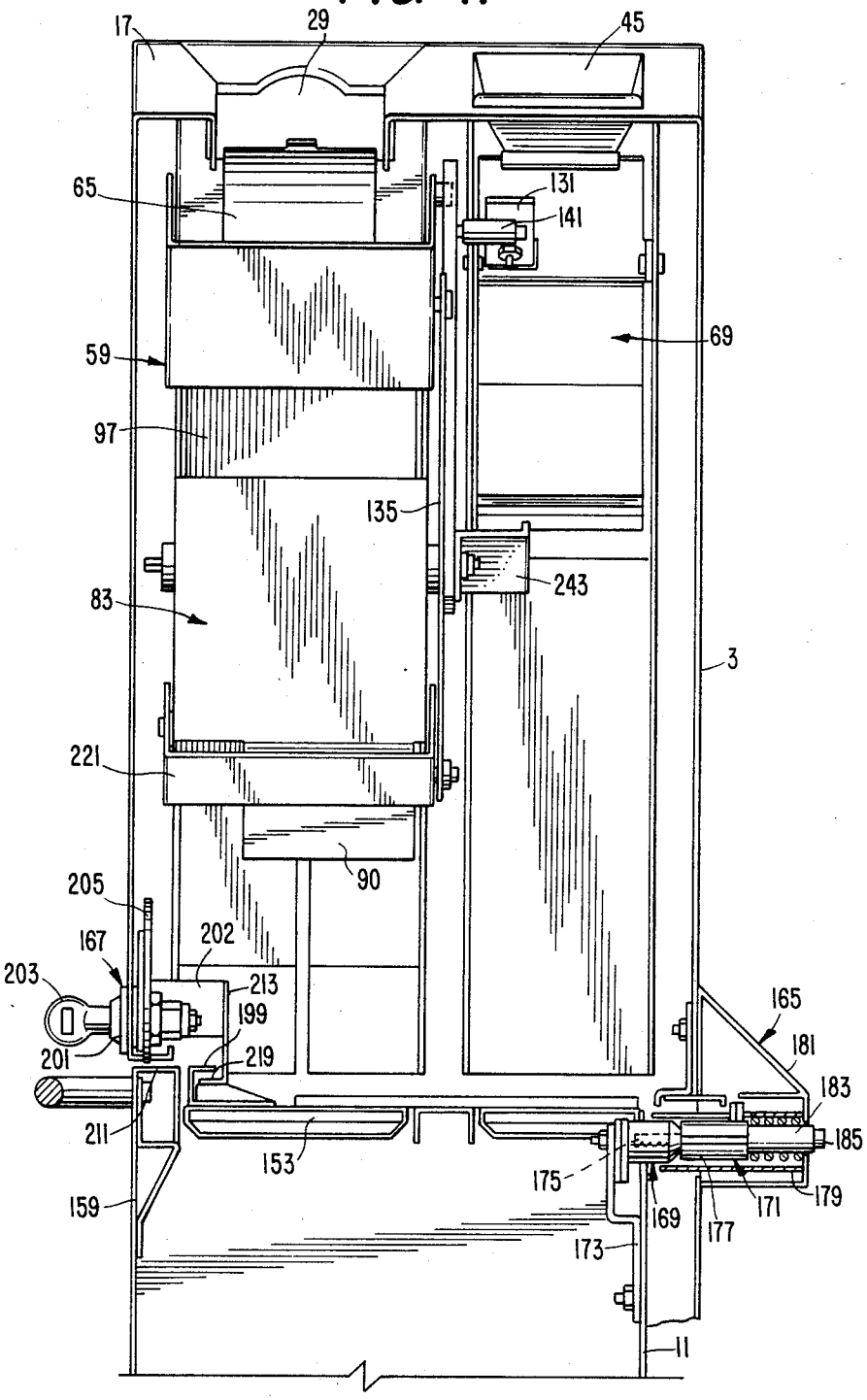
FIG. 4 is a side view mostly of the upper part of the box, rear wall thereof being absent to show the inner structure.

The mechanism 167 comprises, for this purpose, a locking plate 205 (see also FIG. 2) radially projecting from the rotary sleeve 207 of the lock 201 supported on the front wall of the case 3 by a bracket 209. In the locking position of FIG. 6, the plate 205 enters in the receptacle 11 through a slot 211 (FIG. 1) at the top of the front wall 159 of the receptacle. The radial extend of the plate 205 is selected such that it has moved out of the receptacle when the latter is in freeing position, as in FIG. 5. A radial coming plate 213 is also secured to the rotary outer sleeve of the lock 201 through a leg 202 (FIGS. 2 and 4) of plate 205. It has a peripheral coming edge 215 (FIG. 6) and a radial abutment edge 217 formed with a bracket-engageable leg 219 perpendicular to the plate 213. As best seen in FIG. 4, the leg 219 enters the bracket 199 as the receptacle 11 gets fully inserted in its housing 9 and lifts the door 153 when the caming plate 213 is rotated. When the key 203 and the rotary sleeve 207 of the lock 201 are rotated to free the lock plate 205 from the slot 211, the leg 219 forces the door 153 to closed position and when the receptacle 11 is out of the housing 9, the key 175 is removed from the barrel 169 so that the latter is now locked and the door is likewise locked.

Linkage means is provided which is connected to the first guide slide 59 to prevent rotation of the rotary mechanism, which rotation would free the receptacle 11 and would allow it to be removed without the container 57 having first been emptied. If this were possible, paper money could be allowed to pile up in the container 57 and picked up by pivoting the first guide slide 59 after the receptacle 11 has been removed from the housing 9.

Referring particular to FIG. 3, such linkage means comprise a U-shaped abutment strap 221 pivoted at the free ends of its side legs 223, 224 to points 225 on the flanges 87, 88 of the first chute member 83. The strap 221 is also joined to the guide slide 59 by a connecting bar 227 pivoted at one end and at point 229 to the strap 221 and, at the other end, pivoted to the flange 103 of the guide slide 59 at the same point as roller 107 and beneath it. In this manner, pivoting of the operating lever 135 causes like pivoting of the strap 221.

As illustrated in FIG. 6, with the locking plate 205 lodged inside the receptacle 11, the radial abutment edge 217 of the coming plate 213 faces the strap 221 so that the receptacle cannot be freed from the plate 213 unless the connecting bar 227 is lifted out of the way which can only be done by pressing down the transverse bar 145 to pivot the lever 135 and automatically move the lower flap 101 away from the side wall 19 (FIG. 5) thereby opening the container 57 and draining it. This requires of course that the connecting bar 227 be sufficiently long.

As shown in FIGS. 6 and 7, it is preferable that the caming edge 215 be designed so as to hold the connection bar 227 in upward position with the gathering container 57 opened for as long as the door 153 is not fully closed. This may necessitate the provision of a cam extension 233 which would be retractible over the cam plate 213 so as not to protrude into the housing 9 once the receptacle is removed. The extension may be an arcuate member 235 having an arcuated slot 237 through which extend two pegs 239 of the caming plate 213. A pin 241, perpendicular to the member 235 serves to stop the member when the pin reaches a stop bracket (not shown), inside the case, and thus force the member 23 to overlap the plate 213 more fully.

FIG. 7 shows an anti-vibration arm 243 fixed to and alongside the horizontal branch 143 of the operating lever 135. It has an angular notch 245 at its forward end of which the tip butts against the lower edge of the second guide slide 69 in its closed position to prevent it from vibrating. The tip moves away from the guide slide 69 when the lever 135 is actuated.

Figure 11:
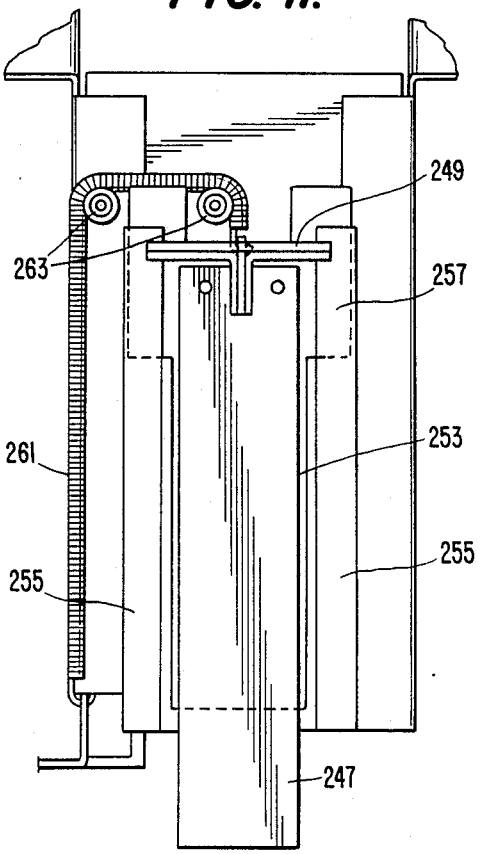
Figure 12:
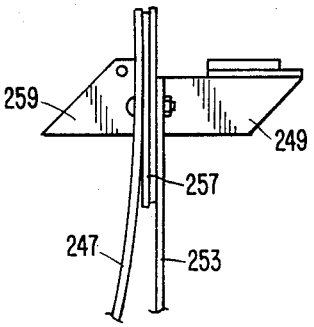
FIG. 12 is an elevation view of the pressing lever par of the mechanism of FIG. 11.
Figure 13:
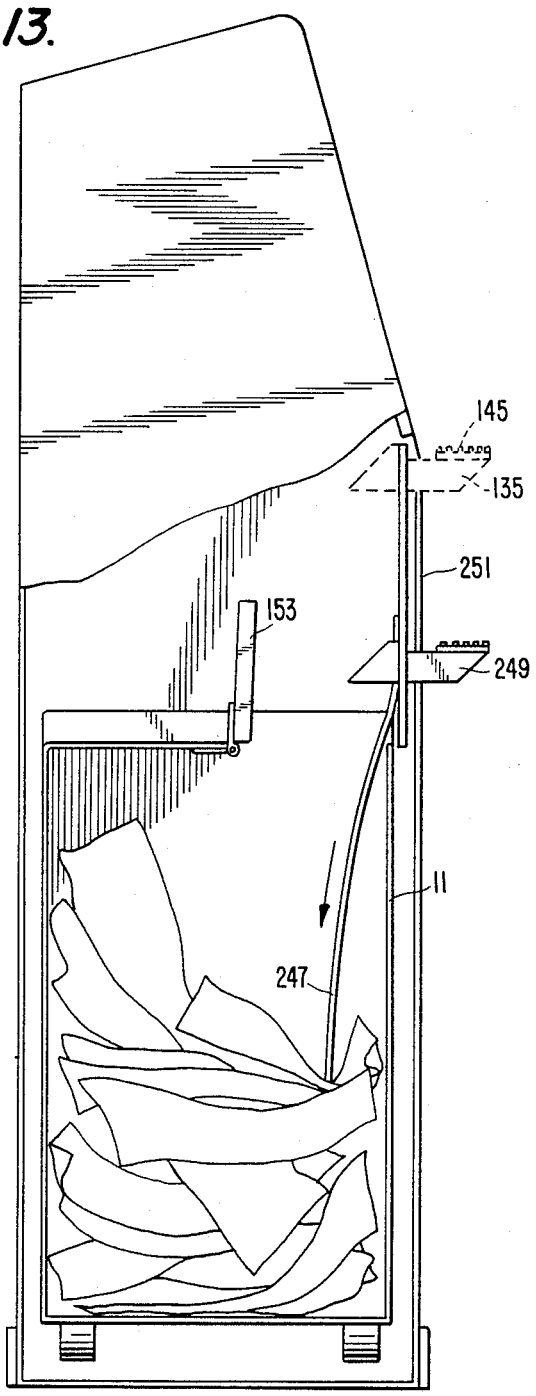
FIG. 13 is a diagrammatic side view of the case, with a side wall torn away to show a strip of the mechanism of FIG. 11 pressing paper money in the receptacle.

Advantageously and with reference to FIGS. 11, 12 and 13 a mechanism may be provided for packing the paper money in the container 11. It comprises a bent strip 247 of metal fixed to a lever 249 extending across a slot 251 of the front wall of the case. A strip 253 is also fixed to the lever 249 to hide the slot 251. The two strips are separated by a spacer pad 257 of which the lateral edges are guided in two channel slides 255 of the chute member 83. A pointed extension 259 of the lever 249 also extends inward of the chute member 83 to assist in driving the paper money into the receptacle 11. Return of the strips 247, 253 and pad 257 is obtained through a spring 261 winding around two small pulleys 263 mounted on the previously mentioned wall (not shown) facing the web 85 of the chute member 83. One end of the spring is fixed to the lever 249 and the other to the lower end of the said not shown wall.

What is claimed:

1. A tamper-deterrent box for collecting travel fees on board of a bus, said box comprising:

a hollow case having an upper part and a lower part and including a top wall, a bottom wall, front, back and side walls; said lower part defining a housing having an opening;

a fee-collecting receptacle removably received in said housing through said opening;

means defining a first slot through said top wall for sliding paper money therethrough;

means defining a second slot through said top wall for dropping coins therethrough;

a first gathering container, beneath said first slot for receiving paper money from said first slot, said first container comprising:

a first guide slide for receiving paper money; said first slide having a free edge and being pivotally mounted for said free edge to be brought against said front wall, and a first viewing window, as part of said front wall for visioning paper money in said first container;

a second gathering container beneath said second slot for receiving coins from said second slot, said second container comprising:

a second guide slide for receiving coins; said second slide having an edge band at one end and being pivotable mounted for said edge band to face said front wall;

a second viewing window as part of said front wall; spacer means on said edge band;

resilient means pressing said spacer means against said viewing window, constructed so that said spacer means create a space between said edge band and said second window allowing said coins to be received, in said space, only flatly and in edge-abutting relation so as to be counted through said second window, and means operable from outside said case for simultaneously pivoting said first slide away from said front wall and said second slide away from said front wall against said resilient means to free said paper money and said coins from said gathering containers to fall toward said fee-collecting receptacle.

2. A box as claimed in claim 1, further comprising a first and a second chute members within said case for receiving said paper money and coins and for guiding same toward said fee-collecting box; said first and second guide slides being pivotally mounted on said first and second chute members, respectively.

3. A box as claimed in claim 2, including means adjusting the opening of said first slot to force entry of paper money, in said first slot in essentially flat condition only.

4. A box as claimed in claim 2, wherein said first slot defining means comprise:

a first portion of said top wall, and a tongue pivoted at one end to a second portion of said top all and having the other end located beneath the first portion.

5. A box as claimed in claim 4, wherein said tongue has teeth, at said other end, bent toward said first gathering container to prevent undue removal of paper money from said first container.

6. A box as claimed in claim 4, further comprising:

adjusting means for moving said tongue other end with respect to said top wall first portion to vary the size of said first slot and force entry of paper money, in said first slot, in essentially flat condition only.

7. A box as claimed in claim 4, wherein said first portion of said top wall is a part of said first viewing window bent in the plane of said top wall.

8. A box as claimed in claim 2, wherein said second slot defining means comprise a trough having a slotted bottom opening into said second container, said trough being solid with said case top wall.

9. A box as claimed in claim 4, wherein said first guide slide comprises:

a paper money receiving section having said free edge brought against said front wall and a pivoted section solid with said receiving section and extending therefrom toward said first slot for receiving paper money; and a pushing tab projecting from the free edge of said pivot section in the direction of said tongue to push paper money, in said first slot, into said first container when said first guide slide is pivoted.

10. A box as claimed in claim 8, wherein said second guide slide comprises: a first section defining said edge band and a second section solid with and extending from said first section along a common edge; the free edge of said second section away from common edge terminating at said slotted opening of said trough to receive coins.

11. A box as claimed in claim 2, wherein said operable means comprise:

an L-shaped lever pivoted, at the apex thereof, to one of said chute members; said lever having an essentially horizontal arm extending out of said case through said front wall for pivotal operation of said lever, and an essentially vertical arm, and cooperating means on said vertical arm and on said first and second guide slides for allowing, when said lever horizontal arm is pressed down, said first guide slide to pivot against gravity and, simultaneously, said second guide slide to pivot against said resilient means whereby said slides are moved away from said one side wall thereby causing paper money and coins that have accumulated in said first and second gathering containers to fall into the respective chutes thereof.

12. A box as claimed in claim 11, wherein said fee-collecting receptacle comprises:

a bottom wall, a partial top wall, front, back and side walls solid with said bottom wall and said partial top wall, and a door pivoted along one edge to said top wall to close said receptacle;

a vertical partition wall within said receptacle dividing said receptacle into a paper money collecting compartment and a coin collecting compartment respectively communicating with said first and second chutes when said door is opened; wherein said box further comprises:

a barrel lock including a key part and a barrel part; said barrel part being mounted on said back wall of said receptacle facing said housing opening and extending out of said receptacle; said barrel lock having a central barrel and an outer rotary sleeve; said key part being fixed to said case backwall facing said receptacle backwall; said key part including a key engaging into said central barrel to hold said barrel stationary and release said sleeve for rotation;

cooperating means on said door and on said sleeve allowing pivotal opening of said door when said key is inserted into said central barrel and locking said door in closed position when said key is removed from said central barrel upon withdrawal of said receptacle from said housing;

a rotary mechanism mounted on the front wall of said case opposite said barrel lock; said mechanism being key operable from outside said case and including means capable of locking said receptacle in said housing while simultaneously opening said receptacle door, and linkage means connected to said first guide slide and preventing rotation of said mechanism to free said receptacle from said housing, said linkage means further allowing such rotation only when said free edge of said first guide slide is pivoted away from said case front wall by said L-shaped lever to thereby cause paper money in said first gathering container to fall into said first chute.

13. A box as claimed in claim 12, wherein said linkage means comprise:

a U-shaped abutment strap pivoted at its free ends to said first chute, and a connecting bar pivoted at one end to said first guide chute and at the other end to said strap, constructed so that said bar causes pivotal movement of said strap when said first chute is pivoted by said L-shaped lever; and wherein said rotary mechanism comprises;

a key operable lock having a rotary sleeve movable between a receptacle-locking position and a receptacle-freeing position of said sleeve;

a radial locking plate on said sleeve extending into said fee-collecting receptacle through a slot of said receptacle top wall to hold said receptacle in said locking position, said plate having a radial extent selected for said plate to have moved out of said receptacle in said freeing position;

a caming plate on said sleeve having a peripheral arcuate caming edge and a radial abutment edge at one end of said caming edge; said caming edge, in said locking position, extending upwardly toward said U-shaped strap with said radial abutment edge facing said strap to prevent said caming plate and said rotary sleeve from rotating into said receptacle-freeing position; said connecting bar of said linkage means having a length selected to allow lifting of said U-shaped strap to free said caming plate upon pivotal movement of said first guide slide away from said case front wall following actuation of said L-shaped lever, and a bracket-engaging leg perpendicular to said caming plate along said radial abutment edge; wherein said receptacle further comprises:

a bracket on said door engaged by said leg for holding said door opened in said locking position of said receptacle and freeing said door when said lock is moved to freeing position.

14. A box as claimed in claim 2, wherein:

said case upper part comprises a head portion and a middle portion; said head portion including said case top wall and part of said front wall of said case;

wherein said guide slides and said chute members are secured to said head portion by means rendered tamper-proof by being located inside of said head portion; and wherein said head portion is secured to said case by means located inside said case and accessible only through said housing opening.

15. A box as claimed in claim 14, wherein said first slot defining means comprise:

a first potion of said top wall, and a tongue pivoted at one end to a second portion of said top wall and having the other end located beneath the first portion.

16. A box as claimed in claim 14, wherein said second slot defining means comprise a trough having a slotted bottom opening into said second container, said trough being solid with said case top wall.

17. A box as claimed in claim 15, wherein said first guide slide comprises:

a paper money receiving section having said free edge brought against said front wall and a pivoted section solid with said receiving section and extending therefrom toward said first slot for receiving paper money; and a pushing tab projecting from the free edge of said pivot section in the direction of said tongue to push paper money, in said first slot, into said first container when said first guide slide is pivoted.

18. A box as claimed in claim 16, wherein said operable means comprise:

an L-shaped lever pivoted, at the apex thereof, to one of said chute members; and lever having an essentially horizontal arm extending out of said case through said front wall for pivotal operation of said lever, and an essentially vertical arm, and cooperating means on said vertical arm and on said first and second guide slides for allowing, when said lever horizontal arm is pressed down, said first guide slide to pivot against gravity and, simultaneously, said second guide slide to pivot against said resilient means whereby said slides are moved away from said one side wall thereby causing paper money and coins that have accumulated in said first and second gathering containers to fall into the respective chutes thereof.

* * * * *